US005224959A

United States Patent [19]

Kasper

[11] Patent Number: 5,224,959

[45] Date of Patent: Jul. 6, 1993

[54] SKELETON BALL

[76] Inventor: Thomas A. Kasper, P.O. Box 884, Agoura Hills, Calif. 91376-0884

[21] Appl. No.: 846,247

[22] Filed: Feb. 18, 1992

[51] Int. Cl.[5] ..... A63B 39/00

[52] U.S. Cl. ..... 273/58 B; 273/58 D; 446/26; 446/85

[58] Field of Search ..... 273/58 D, 58 R, 156, 273/158, 159, 58 B, 58 BA, 220; 63/3, 11; 482/55, 74, 105; 446/26, 85, 486, 487; 428/9, 11, 12

[56] References Cited

U.S. PATENT DOCUMENTS

| | | | |
|---|---|---|---|
| 1,972,128 | 9/1934 | Bobbroff | 273/158 |
| 2,738,616 | 3/1956 | Windle | 63/11 |
| 2,771,768 | 11/1956 | Tudor | 63/3 |
| 3,046,016 | 7/1962 | Laws | 273/58 D |
| 3,695,617 | 10/1972 | Mogilner et al. | 273/159 |
| 4,219,958 | 9/1980 | Shulyak | 446/487 |
| 4,295,187 | 10/1981 | Shemitz | 428/12 |
| 4,637,941 | 1/1987 | Rochte | 428/11 |

*Primary Examiner*—V. Millin

*Assistant Examiner*—Steven B. Wong

[57] ABSTRACT

A skeleton ball comprising a plurality of loops woven together into a spheroidal grid derived from polyhedral geometry. The loops comprise elongated rod, strand or tube elements joined at the ends subsequent to the weaving process. Only one joint per loop element is required. The grid's connections are frictionally secured through mutual flexural deformation of loops as a result of the weaving process. The frictionally-secured connections allow some embodiments to be collapsed or folded flat through relative sliding motion of loops. Relative sliding motion of loops also allows enlargement of grid openings so the ball may be used as a tote or container. The ball may be designed for bouyancy without need for inflation. The ball is suitable as a swimming or aquatic exercise aid affixed to the limbs through relative sliding of loops. The ball may be fabricated from widely available materials with little capital equipment or material preparation; modification or adaption of the ball to meet a diverse range of applications is discussed.

12 Claims, 6 Drawing Sheets

SKELETON BALL

BACKGROUND OF THE INVENTION

The present invention generally relates to balls and more specifically to a skeleton ball that may be readily adapted for exercise or rehabilitation in or around water.

Balls used for recreation, physical training and physical rehabilitation are widely known in the literature. Such balls may be constructed as inflated membranes, rigid shells or skeletal space frames. The former two constructions are beyond the scope of the present invention.

Skeleton balls have the unique property of being easily grasped by passing the fingers of the hand through openings and gripping the skeletal elements. This property is especially desirable for physical education of handicapped, disabled, injured or young individuals with limited manual dexterity or poor hand-eye coordination. Skeleton balls analagously lend themselves to games whereby the ball is projected towards a peg or hook in a fashion similar to conventional ring-toss games.

Balls used in and around water, such as at the beach or in a swimming pool, must float to facilitate use and avoid loss. Skeleton balls generally float poorly or not at all unless some means of inflation of the skeletal elements is provided. A skeleton ball that may be readily designed to have inherent bouyancy without need for inflation would be an improvement over previously known skeleton balls.

Skeleton balls are especially valuable as hydrotherapy aids. Hydrotherapy consists of performing motion exercises while partially immersed in a swimming pool or tank specifically designed for such purposes. Skeleton balls, being easily grasped and providing substantial fluid resistance, are used to increase muscle activity and metabolic output. There are available rather complex appliances that may be affixed to the limbs with straps or similar means; they also serve to increase fluid resistance. It would be desirable to adapt the simplicity of the skeleton ball to meet the needs served by complex strap-on appliances.

Storage and transport of balls has, in the past, been hindered by the relatively large volume of space required per ball. Institutions with large inventories, and physical trainers who travel with equipment to various training sites would benefit greatly from a means to reduce the storage space requirements of their balls. Inflated balls may be collapsed by deflating them; the extreme inconvenience of the deflation-inflation cycle negates this as a viable means of reducing short-term storage requirements. A soft, pliable skeleton ball may be readily crushed to reduce its volume, however, ease of crushing is generally antagonistic to playability.

Balls suitable as tote bags or containers for towels or other objects are widely known, most of them being constructed as rigid shells. Skeleton balls suitable as totes or containers are less well known, but do exist. In the past, adapting a skeleton ball to a tote bag generally involved the use of discrete snap-type joints that allowed a region of the ball's surface grid to be opened. Such joints are not only expensive to fabricate, they are vulnerable to wear and breakage. A skeleton ball suitable for use as a tote, but not requiring any separate joints or snaps would be a definite improvement over previously known skeleton balls.

Heretofore, skeleton balls have been constructed as assemblies of large numbers of discrete, elongated elements and as integrally molded frames. Skeletons comprising large numbers of discrete elements are costly to produce due to the large number of joints required, generally at least two per element. In addition, specialized material preparation is often required prior to the joining operations. Molding integral frames requires considerable capital equipment and usually separate operations to join two or more sections. More economical fabrication methods would be desirable.

U.S. Pat. No. 3,889,950, teaches a skeleton ball comprised of a relatively large number of elongated elements with at least twice as many joints; the primary embodiment shown comprises thirty elements and sixty joints. There is no provision for collapsing the ball for storage other than crushing it flat. Flotation is achieved only through separate means for inflation of tubular elements. This ball is suitable as a tote bag only if separate means for opening and closing (i.e. snaps) is provided. Fabrication of the ball requires the elongated elements be joined at the ends and also midway along their length, the latter being cumbersome and relatively expensive.

U.S. Pat. No. 4,813,674, teaches a specialized skeleton ball comprised of elongated strip material specially prepared and assembled in a complex fashion. The ball has no provision for flotation or collapsibility and is not easily grasped due the small openings and nature of the elongated strip material. The ball is not suited for use as a tote or container. The ball is specifically intended for the game of takraw, a South East Asian game mostly foreign to the United States. Takraw is similar to American vollyball or soccer in that the ball is struck with portions of the body; the ball preferrably has a predominantly closed smooth surface with relatively few small openings.

Previously known skeleton balls, including the above mentioned balls, suffer from several deficiencies: they are not inherently bouyant or water compatible; they do not readily collapse or fold to reduce their volume; they are not suitable as totes or containers unless provided with separate means for opening and closing them; and they are relatively expensive to fabricate due to excessively large numbers of elements and joints and/or specialized material preparation or processing.

Accordingly, among the objects of the present invention are:

to provide a skeleton ball that is water compatible and inherently bouyant without need for inflation;

to provide a skeleton ball that may be easily and rapidly folded to reduce its volume;

to provide a skeleton ball that is suitable as a tote or container without need for snaps, clasps or other separate means for opening and closing it;

to provide a skeleton ball that is readily fabricated from widely available materials with a minimum of capital equipment and processing;

to provide a skeleton ball that comprises relatively few discrete elements and joints, the majority of the connections being frictionally secured; and to provide a skeleton ball whose geometry and composition is readily adapted or modified to meet a diverse range of applications.

This listing of objects and advantages is not intended to be exhaustive or limiting, but summarily brief. Further objects and advantages will be apparent from consideration of the detailed description of the invention.

SUMMARY OF THE INVENTION

The present invention provides a skeleton ball comprising a plurality of flexurally rigid loop interwoven into a spheroidal grid. The loops comprise elongated rod, tube or strand elements joined at the ends to form loops subsequent to the weaving process. The loops flexurally deform to compensate for geometric interference that occurs at the woven crossings because of the loops' thickness. The deformation causes contact forces between the loops and subsequent friction forces that secure them together. The ball may be fabricated using only one joint per element, with frictionally secured overlappings of loops providing the majority of connections. Certain embodiments of the invention may be collapsed flat for storage and/or undergo selective enlargement of surface openings to allow access to the interior of the ball. Certain embodiments may be affixed to the limbs of the body for aquatic exercise.

DETAILED DESCRIPTION OF THE PREFERRED EMBODIMENTS

A complete disclosure of the present invention and its preferred embodiments will now be presented with reference to the aforementioned drawings.

Figure 1:
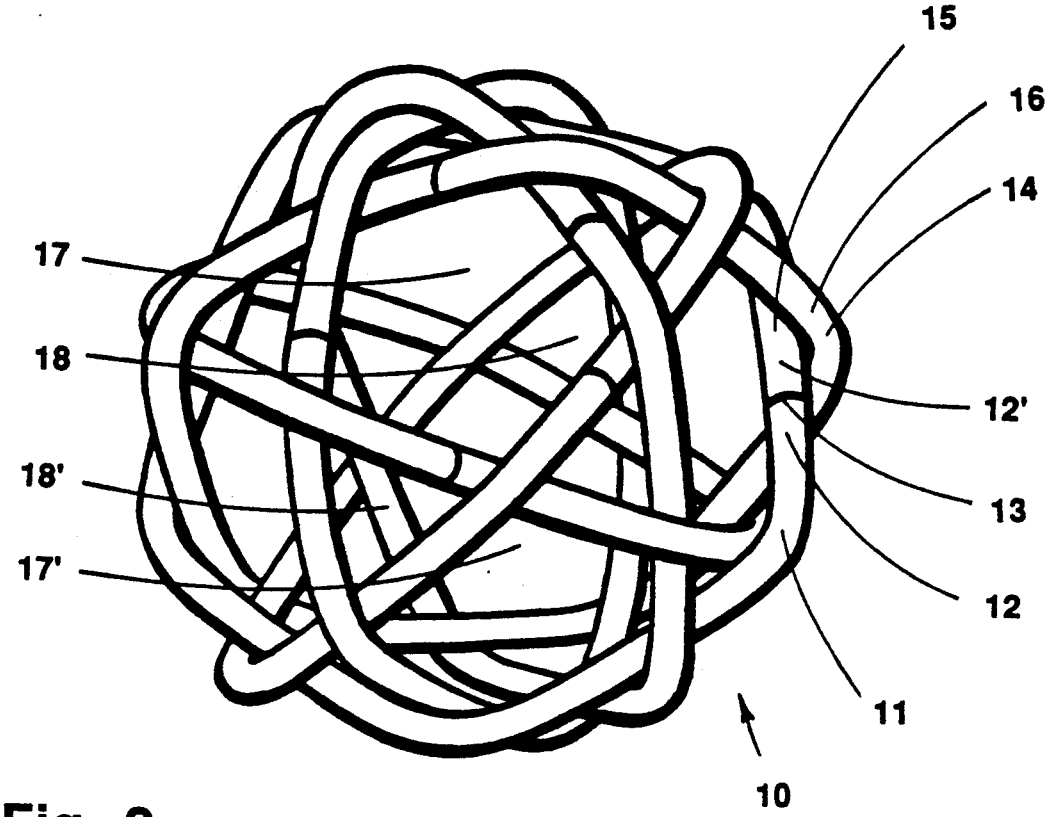
FIG. 1 is a perspective view of a preferred embodiment of the invention, a foldable skeleton ball of substantially spherical shape.

FIG. 1 shows a preferred embodiment of the present invention, a foldable skeleton ball 10 comprising a plurality of loops 11 woven together into a spheroidal grid of framework. Loops 11 comprise elongated flexible rod or strand elements that have substantially continuous flexural rigidity. Free ends 12, 12' are affixed by flexurally rigid joints 13 subsequent to weaving.

Ball 10 comprises six pair of diametrically opposed pentangular openings 17, 17' and ten pair of diametrically opposed triangular openings 18, 18''. Alternative embodiments will generally comprise differing numbers of these and other shapes of openings.

Loops 11 cross or overlap one another at a plurality of woven overlappings 14. An overlapping 14 comprises an radially inwardly displaced arc portion of a first loop 15 juxtaposed to and in contact with an radially outwardly displaced arc portion of a second loop 16. Cross-sectional thickness of loops 11 causes substantial geometric interference at overlappings 14 between inwardly displaced arc portions 15 and outwardly displaced arc portions 16. Mutual flexural deformation of loop regions 15, 16 compensates for this geometric interference and causes substantially radial forces and considerable friction to occur between regions 15, 16. This friction substantially resists relative sliding motion of regions 15, 16 and effectively secures them. Ball 10 comprises six loops, six joints and thirty frictionally-secured overlappings 14.

Figure 2:
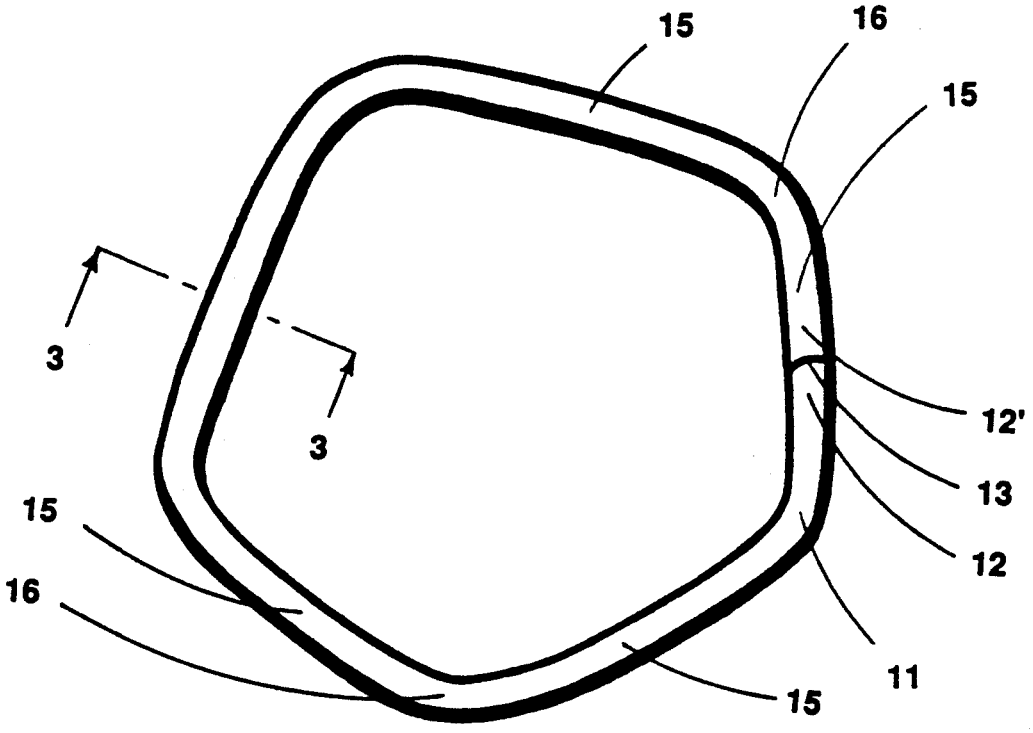
FIG. 2 is a fragmentary view of the embodiment shown in FIG. 1 showing one loop; the remaining loops have been removed for clarity.

FIG. 2 is a fragmentary view of the ball of FIG. 1; all but one loop have been removed for clarity. Loop 11 is flexurally deformed by inwardly acting radial forces at inwardly displaced arc portions 15 and outwardly acting radial forces at outwardly displaced arc portions 16. The radial forces are produced by deformation of the remaining loops. In general, there are equal numbers of inwardly displaced are portions and outwardly displaced arc portions comprising a single loop and they alternate around the loop. Flexural rigidity of loop 11 is essentially constant, even in the vicinity of joint 13.

Geometric considerations alone determine the extent of the geometric interference, and deformation of loop regions 15, 16 to compensate for it. By contrast, flexural rigidity of loops 11 determines the magnitude of radial forces between loop regions 15, 16 and resulting friction forces. Flexural rigidity is controlled by selection of materials. In general, stiffer materials create more friction, as do thicker loops.

Figure 3A:
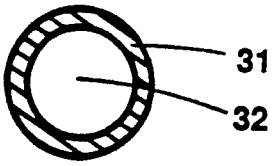
FIG. 3A is a cross-sectional view taken along lines 3—3 in FIG. 2.

FIG. 3A is a cross-sectional view taken along line 3—3 in FIG. 2. Loop 11 comprises elongated metal or plastic tubing 31 surrounding a central space 32. Metal is superior in terms of longevity and stiffness, while plastic is preferred for water-borne embodiments. Central space 32 may contain or entrap air for the purpose of increasing bouyancy of ball 10, or may contain water, sand, lead shot or other similar material for the purpose of increasing weight of ball 10. Tubing 31 may be perforate or imperforate and be of non-circular cross section.

Inherent bouyancy of ball 10 may be attained by proper selection of tubing 31. Plastic tubing generally has a density very nearly that of water. When the volume of entrapped air in space 32 is a substantial fraction, say 75%, of the total volume of the ball 10's loops 11, satisfactory flotation is attained. For instance, one successful embodiment of the present invention comprises loops of polyethylene tubing of 9.5 mm outside diameter, 7.5 mm inside diameter and 750 mm length; a majority of the ball's volume remains above water as it floats. Because there is no need for separate inflation means, reliability and utility of the ball is superior to inflated skeleton balls.

Figure 3B:
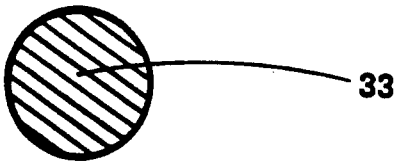
FIG. 3B is a cross-sectional view similar to FIG. 3A illustrating an alternative embodiment of the invention.

FIG. 3B is a view similar to FIG. 3A whereby one embodiment of the invention comprises loops 11 comprising solid elongated metal or plastic rod or strand 33. Rod or strand 33 may be of non-circular cross-section. Embodiments of this kind generally do not float, but possess superior resiliency for bouncing and durability for use with pets such as dogs.

Figure 3C:
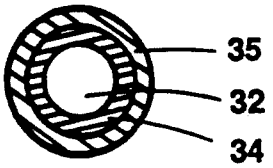
FIG. 3C is a cross-sectional view similar to FIG. 3A illustrating yet another embodiment of the invention.

FIG. 3C is a view similar to FIG. 3B whereby loop 11 comprises at least one elongated metal or plastic tubular core 34 internally positioned within elongated tubular outer jacket 35. Core 34 surrounds space 32 which may contain or entrap air, water, sand or similar materials. Core 34 and outer jacket 35 may be perforate or imperforate and be of non-circular cross-section. Tubular core 34 is preferrably stiffer than outer jacket 35 and may be coextruded. Properties of one material may be synergistically combined with properties of another to produce ball 10. For example, tubular core 34 may comprise relatively stiff nylon, and outer jacket 35 comprise relatively soft urethane; the nylon provides high flexural rigidity while the urethane provides a soft, high friction outer covering.

Figure 3D:
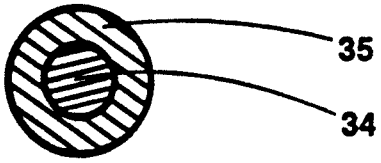
FIG. 3D is a cross-sectional view similar to FIG. 3A illustrating yet another embodiment of the invention

FIG. 3D is a view similar to FIG. 3C whereby loop 11 comprises a solid metal or plastic core 34 internally positioned within elongated tubular outer jacket 35. Core 34 may be of non-circular cross-section. Core 34 is preferrably stiffer than jacket 35, which may be perforate or imperforate.

Returning to FIG. 2, joint 13 comprises a first free end 12, a second free end 12' and suitable joining means for affixion of free end 12 to free end 12'. Suitable joining means may comprise heat, solvent or adhesive bonding, internal or external fittings, snap-fit joints or similar well-known techniques. In general, continuous flexural rigidity of loop 11 through joint 13 is preferred. Fluid-tight joints are preferred for embodiments intended for use in conjunction with water. The joining means may be permanent, or the joints may be releasable to permit repeated assembly and disassembly as an educational exercise. The appropriate joining means is dictated by material selection and intended application.

Figure 4:
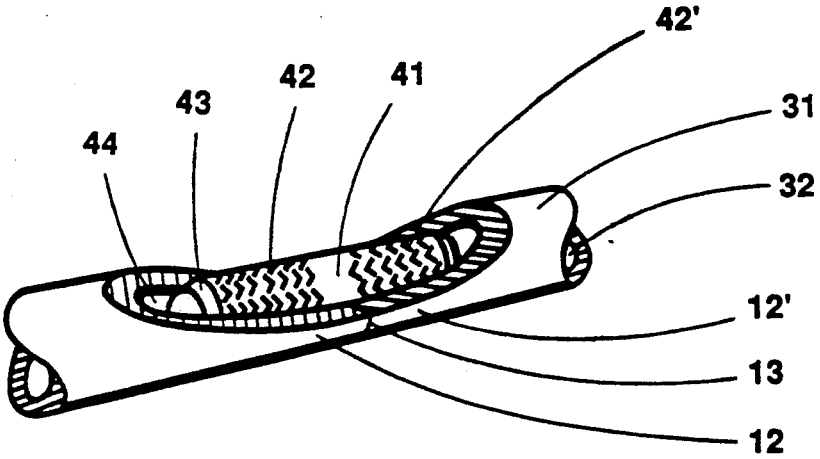
FIG. 4 is an enlarged, partially cut-away fragmentary view of the joint of the loop shown in FIG. 2.

FIG. 4 shows an enlarged cut-away view of joint 13 of FIG. 2, illustrating a preferred joining means for relatively inert plastic tubing. For example, polyethylene and polypropylene are relatively inert plastic materials that are substantially impervious to solvents or adhesives, yet are economical. Free ends 12, 12' are affixed by means of flexurally rigid fitting 41 internally positioned within space 32 and secured to interior wall 44 of tubing 31 by mechanical gripping regions 42, 42'. Mechanical gripping regions 42, 42' preferrably comprise a plurality of directional barbs which resist removal of fitting 41 from space 32, but permit easy insertion. Fitting 41 preferrably fits snugly in tubing 31 and has a bevel 43 to facilitate entry into space 32.

Figure 5:
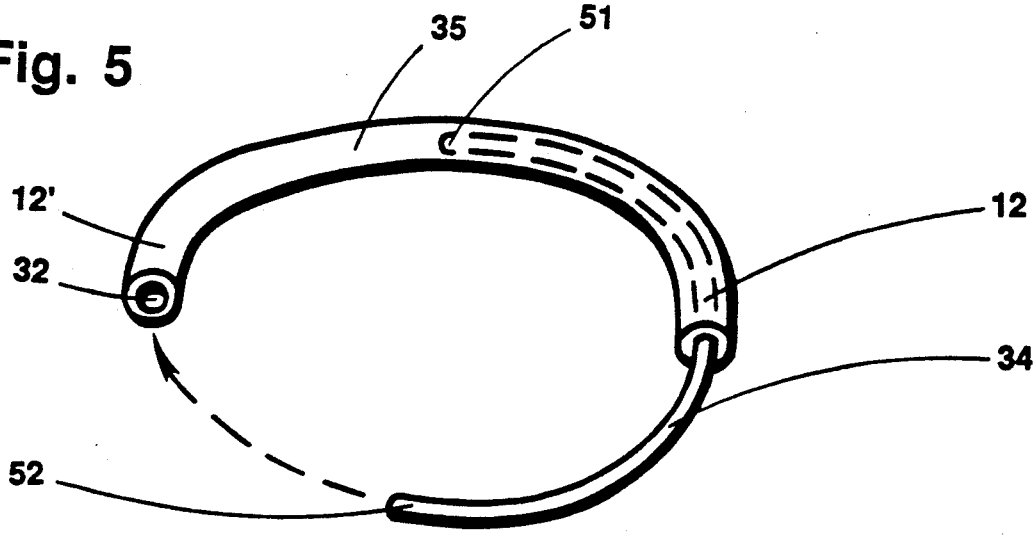
FIG. 5 is a perspective view of a single loop of an alternative embodiment during the assembly procedure.

FIG. 5 shows a preferred joining means for the embodiment shown in FIG. 3D during the assembly procedure. Core 34 preferrably fits closely within jacket 35 and is the same length. Core first end 51 is inserted into space 32 of jacket 35 at free end 12 until approximately one-half of core 34 is within jacket 35. Core second end 52 is subsequently inserted into space 32 of jacket 35 at free end 12' until free end 12 abuts free end 12' and core first end 51 abuts second end 52. Core 34 may be secured within jacket 35 by any of the aforementioned joining means.

Figure 6A:
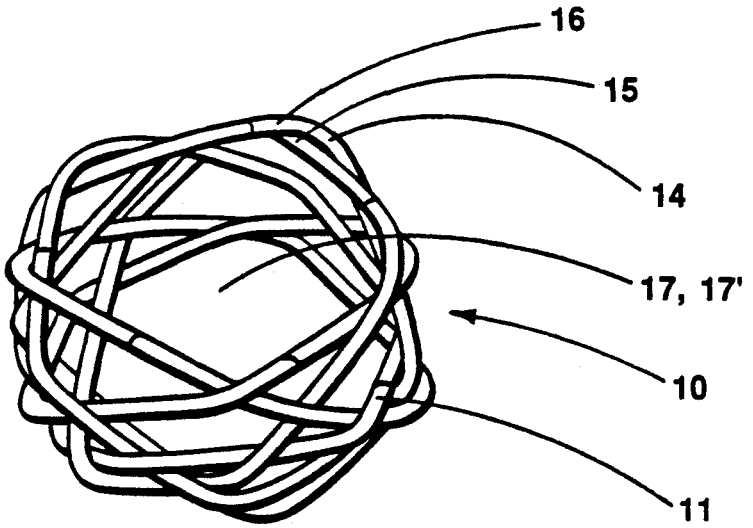
FIG. 6A is a perspective view of the ball of FIG. 1 partially collapsed or folded.
Figure 6B:
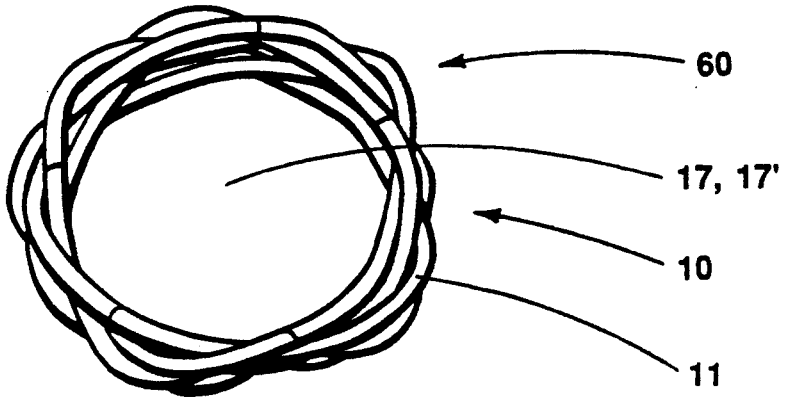
FIG. 6B is a perspective view of the ball of FIG. 1 fully folded.

FIG. 6A shows ball 10 of FIG. 1 partially folded; FIG. 6B shows it fully folded or collapsed. During the folding procedure two diametrically opposite pentangular opening 17, 17' are enlarged. Frictionally secured overlappings 14 allow relative sliding motion between loop regions 15, 16. When fully collapsed, ball 10 is the form of ring 60 and openings 17, 17' are maximally enlarged. Folded towels or other objects may be placed within ring 60 and loops 11 subsequently pulled apart to form ball 10 with objects inside. In a similar manner, pentangular opening 17 may be enlarged through relative sliding of regions 15, 16 to allow objects to be placed within ball 10 without collapsing it. Thus, ball 10 is suitable as a tote or container without need for snaps, clasps or other separate means for opening and closing it.

The above preferred embodiment is a spherical ball comprising six identical loops. Embodiments of differing shape and comprising differing numbers of loops arranged in differing grid patterns exist and are ready adaptions of ball 10. One or more loops may be modified in terms of sizing or composition to obtain alternative embodiments. Additionally, the grid may be modified in terms of numbers of loops 11 or geometric pattern.

Figure 7:
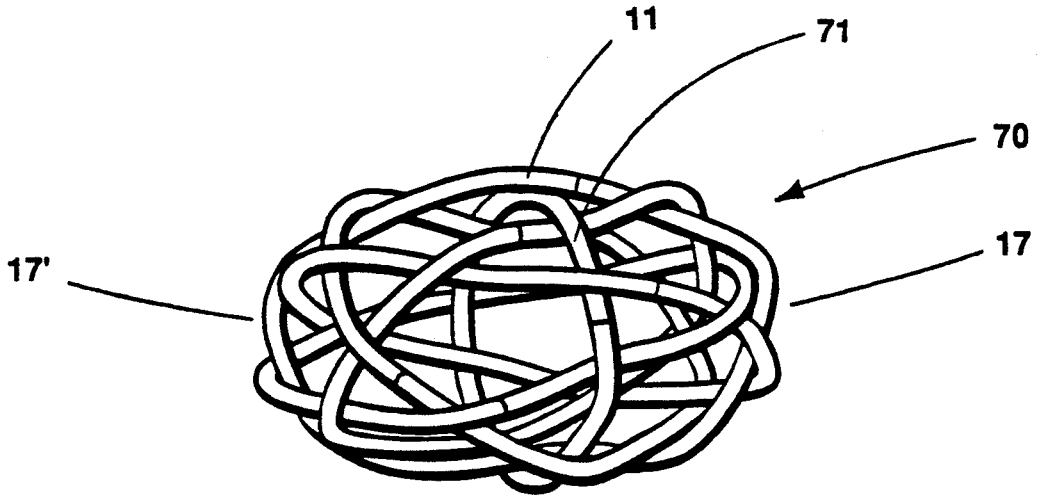
FIG. 7 is a perspective view of an alternative embodiment of the invention, a football-shaped skeleton ball.

FIG. 7 illustrates an alternative embodiment of the present invention, a skeleton ball 70 in the ellipsoidal shape of a football. Ball 70 is substantially similar to ball 10 of FIG. 1 with the exception of modified loop 71, which is shorter than loops 11. Opposite pentangular openings 17, 17' allow ball 70 to be folded in a fashion similar to ball 10 in FIGS. 6A, 6B. In addition, opening 17 may be enlarged to allow access to interior of ball 70.

Figure 8A:
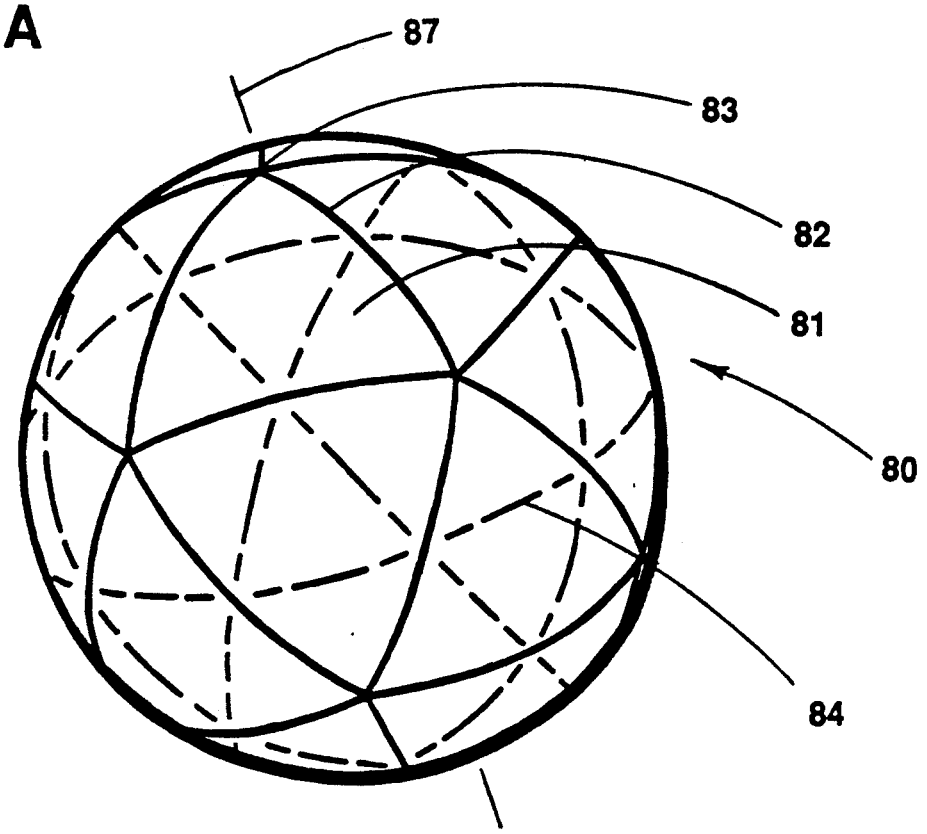
FIG. 8A is a perspective view of a spherical icosahedron with six great circles superimposed on the surface.

FIG. 8A is a view of an icosahedral sphere 80, a geometric figure comprising twenty spherical equilateral triangles 81. Triangles 81 comprise three edges 82 and meet in groups of five at vertices 83. Superimposed on sphere 80 are great circles 84 derived by rotating sphere 80 about axes 87 normal to sphere 80 at vertices 83. There are six pair of diametrically opposite vertices which produces a symmetric system of six great circles. The skeletal grid of ball 10 of FIG. 1 is substantially similar to and readily derived from the six great circles 84.

Figure 8B:
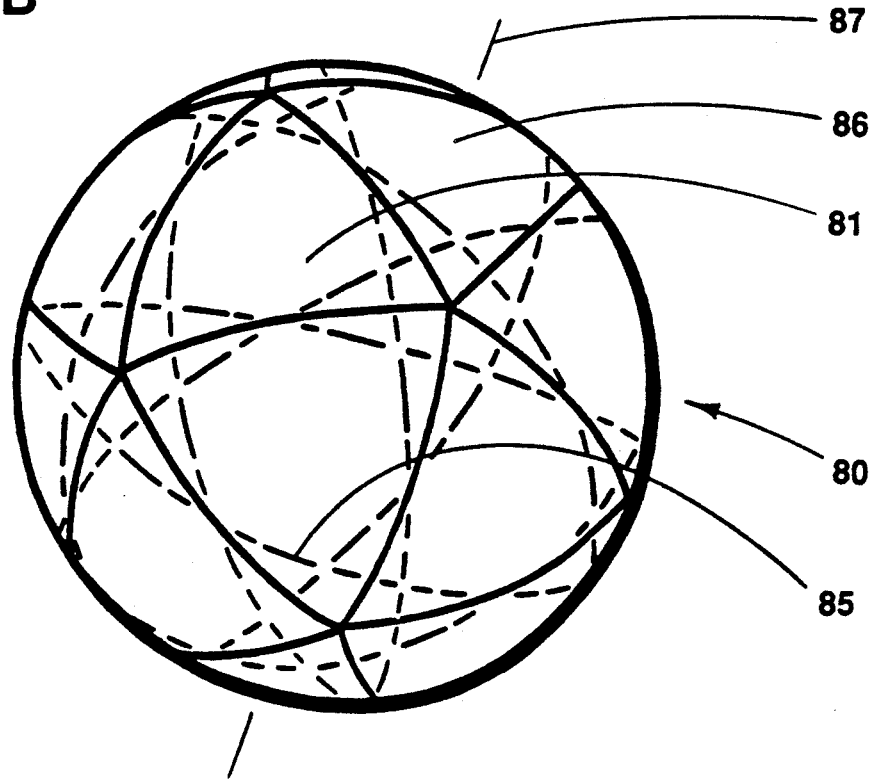
FIG. 8B is a view similar to FIG. 8A where ten great circles are superimposed on the surface of a spherical icosahedron.

FIG. 8B is a view similar to FIG. 8A whereby sphere 80 is shown with a system of ten great circles 85. Rotational axes 87 passing through ten pair of diametrically opposite centroids 86 of triangles 81 define ten circles 85. Embodiments of the invention comprising a grid derived from the ten great circles 85 have relatively small openings or tighter mesh and do not fold as readily.

The icosahedral sphere and its systems of six and ten great circles have been listed for purposes of illustration and not limitation. In general, any quasi-symmetric polyhedron may be used to derive systems of great circles. Also, lesser circles substantially parallel to and corresponding to great circles may be used to derive grids comprising additional loops. Embodiments based upon geodesic-dome-type polyhedrons may comprise substantially larger numbers of loops. Foldability generally decreases with increased numbers of loops.

Figure 9:
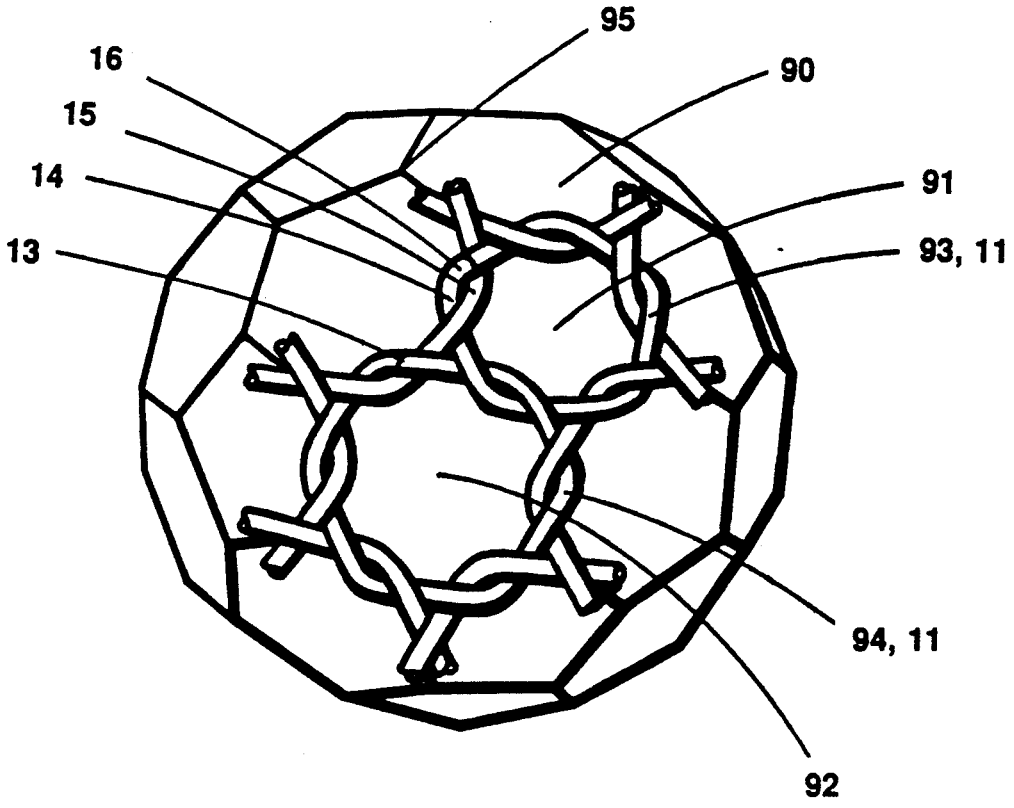
FIG. 9 is a perspective view of a fragment of one embodiment of the present invention overlayed on a polyhedron upon which it is based.

FIG. 9 illustrates yet another embodiment of the invention, whereby the grid pattern comprises a polyhedron having facets with a one-to-one correspondance between loops 93, 94 and facets 91, 92 of polyhedron 90. For purpose of illustration, polyhedron 90 is a truncated icosahedron; it comprises twelve pentagonal facets 91 and twenty hexagonal facets 92 meeting in groups of three at vertices 95. Loop 93 corresponds to pentagonal facet 91 and is interwoven with five other loops. Loop 94 corresponds to hexagonal facet 92 and is interwoven with six other loops. The interweaving comprises overlappings 14 comprising interiorly displaced loop regions 15 and exteriorly displaced loop regions 16; loops 93, 94 are closed by joints 13 subsequent to weaving. In general, any polyhedron whose facets meet in groups of three at vertices is suitable. Some suitable polyhedrons include hexahedrons (cubes), dodecahedrons and geodesic-dome-type "hex-pent" polyhedrons. Embodiments of this kind do not fold.

While the above embodiments preferably comprise frictionally-secured overlappings 14, certain embodiments more suitably comprise additional fixation of the frictionally-secured overlappings to control or eliminate foldability or otherwise modify properties of the embodiments.

One specialized application for the skeleton ball of the present invention involves its use in conjunction with water for physical training or rehabilitation.

Figure 10A:
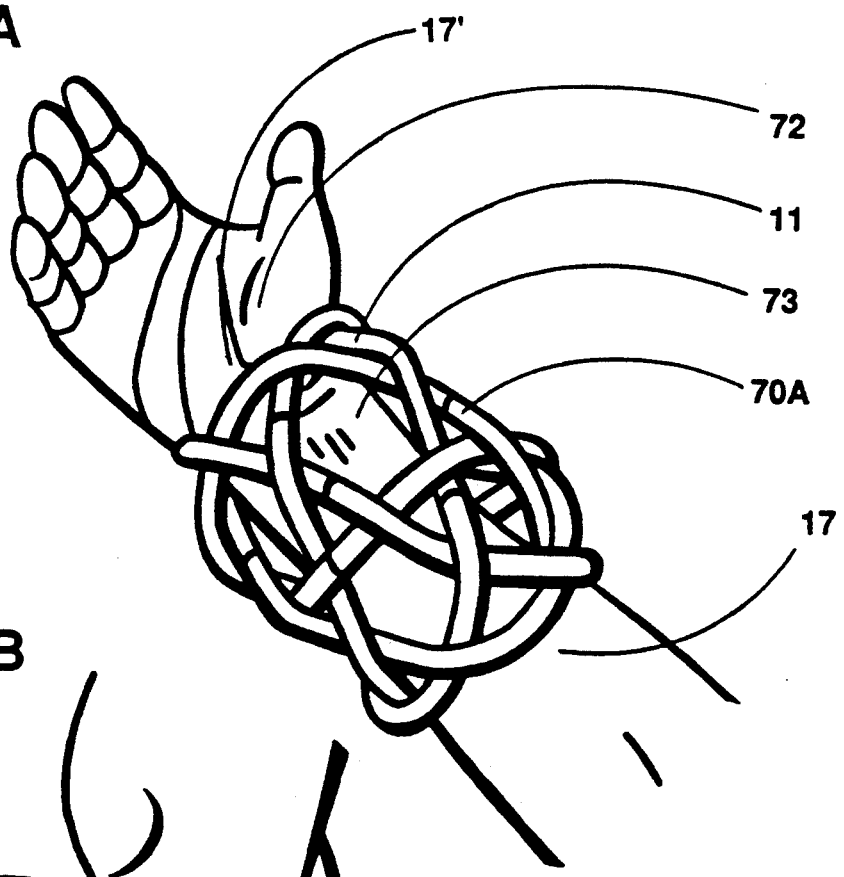
FIG. 10A is a perspective view of an embodiment of the invention affixed to a user's arm.

FIG. 10A shows an ellipsoidal skeleton ball 70A affixed to the distal portion of a user's arm 73. Opposite pentangular openings 17, 17' are enlarged through relative sliding of loops 11 to allow hand 72 to pass completely through ball 70A. Relative sliding of loops 11 then allows openings 17,17' to be closed around arm 73 and prevent any motion of ball 70A relative to arm 73. Generally a second ball is similarly affixed to the other arm.

Figure 10B:
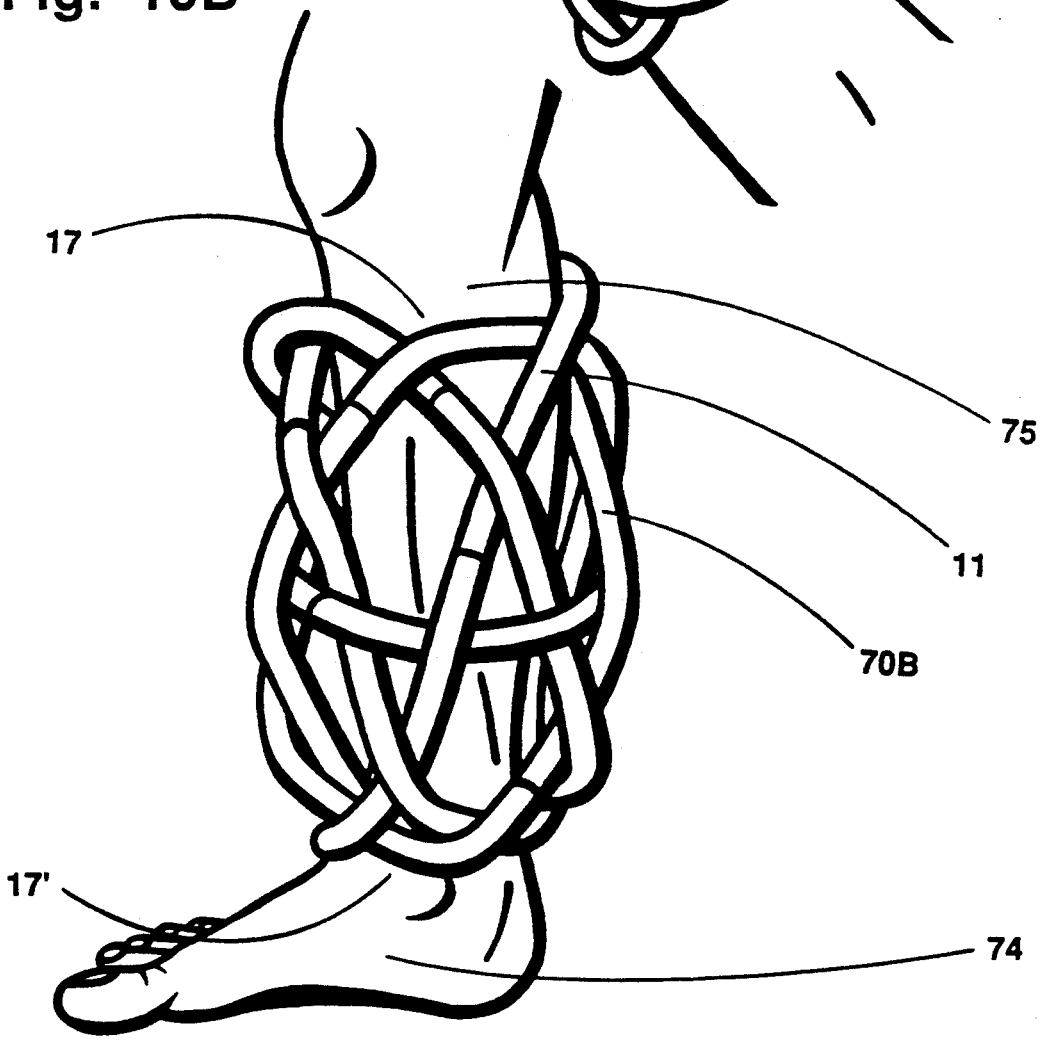
FIG. 10B is a view similar to FIG. 10A showing an embodiment of the invention affixed to a user's leg.

FIG. 10B shows a similar, larger ellipsoidal skeleton ball 70B affixed to the distal portion of a user's leg 75. Enlargement of openings 17, 17' permits ball 70B to be placed over foot 74 and snugly secured to leg 75 through relative sliding of loops 11. Generally a second ball is similarly affixed to the other leg.

Once skeleton balls 70A, 70B are affixed to limbs 73, 75, the user enters a pool, tank or other body of water and performs exercises such as swimming, treadmill walking or similar exercises whereby the body moves relative to the water. Balls 70A, 70B cause increased resistance to such motion because of increased turbulence and fluid-dynamic drag. Balls 70A, 70B preferrably conform closely to limbs 73, 75 so that undesirable interference or rubbing is avoided. In addition to limbs 73, 75, suitable skeleton balls may be placed over parts of the anatomy, such as the torso, so that motion of the whole body through water is resisted. The symmetry of the balls ensures no tendency to rotate regardless of direction of motion. Differing sizes of balls provide a ready means for adjusting exercise intensity. The inherent adjustability of the ball to the user obviates the need for straps or other separate means of affixion, making the present invention the preferred means for increasing motion resistance during aquatic exercise.

While the invention has been particularly shown and described in reference to the preferred embodiments thereof, it will be understood by those skilled in the art that changes in form and details may be made without departing from the scope, spirit and principles of the invention. Thus, by way of example and not limitation, the skeleton ball of the present invention may take on the various forms presented.

I claim:

1. A skeleton ball comprising:

a plurality of loops woven together into a hollow spheroidal skeletal grid, said ball having an outer surface which is predominantly open space and thus making said ball suitable for allowing a user's fingers to pass through said surface and grip said loops;

said loops comprise flexible elongated strand elements closed by joints subsequent to said weaving; said strand elements possess flexural rigidity which is substantially continous throughout said strand elements and resists flexural deformation thereof; said strand elements further possess thickness sufficient to cause substantial geometric interference between said strand elements when woven together; said joints comprise a first free end of one said element, a second free end of same said element and means for affixion of said first free end to said second free end;

said woven grid comprises a plurality of overlappings with each said overlapping comprising an inwardly displaced arc portion of a first said loop juxtaposed to and in surface contact with an outwardly displaced arc portion of a second said loop; said inwardly displaced arc portion is substantially radially inward toward a centroid of said ball and said outwardly displaced arc portion is substantially radially outward away from said centroid of said ball;

said inwardly and outwardly displaced arc portions are displaced by mutual and opposite radial forces between said overlapping arc portions at said surface contacts; said inwardly displaced arc portions are displaced by radial forces directed substantially toward said centroid of said ball and said outwardly displaced arc portions are displaced by radial forces directed substantially away from said centroid of said ball;

said radial forces occur as mutual and opposite pairs at said overlappings and are caused by mutual and opposite flexural deformations of said arc portions; said flexural deformations compensate for said geometric interference between said arc portions at said overlappings and thus allow said arc portions to pass one another at said overlappings;

said mutual and opposite radial forces at said overlappings cause substantial surface friction forces between said overlapping arc portions such that a) relative sliding motion of said arc portions is resisted and b) said loops are effectively secured to one another by said friction forces such that no additional means of affixion of one said loop to a second said loop is necessary;

said inwardly displaced portions of one said loop are equal in number to said outwardly displaced portions of same said loop; said inwardly displaced arc portions are positioned between and are bordered by said outwardly displaced arc portions; thus, said inwardly displaced arc portions alternate with said outwardly displaced arc portions around a circumferential length of said loop.

2. A skeleton ball in accordance with claim 1 whereby;

said grid comprises six loops and is collapsible, said collapsibility taking place through relative sliding motion of said arc portions at said overlappings; said relative sliding motion overcoming said friction forces between said arc portions;

said relative sliding motion causes enlargement of openings of said skeletal grid, said enlargement allowing access to an interior of said ball for purpose of placing objects therein.

3. A skeleton ball in accordance with claim 1 whereby;

said grid comprises six tubular plastic loops and is collapsible, said collapsibility taking place through relative sliding motion of said arc portions at said overlappings; said relative sliding motion overcoming said friction forces between said arc portions;

said relative sliding motion causes enlargement of openings of said skeletal grid, said enlargement allowing access to an interior of said ball for purpose of placing objects therein.

4. A skeleton ball in accordance with claim 1 whereby;

said grid is collapsible, said collapsibility taking place through relative sliding motion of said arc portions at said overlappings; said relative sliding motion overcoming said friction forces between said arc portions;

said relative sliding motion causes enlargement of openings of said skeletal grid, said enlargement allowing access to an interior of said ball for purpose of placing objects therein;

said access permitting said ball to be placed over and surround parts of human anatomy for a purpose of increasing motion resistance during aquatic exercise.

5. A skeleton ball in accordance with claim 1, whereby;

said loops comprise elongated tubular plastic elements, said joint are fluid-tight and interior spaces of said tubular elements contain air for purpose of causing said ball to be inherently bouyant in water, 6. A skeleton ball in accordance with claim 1, whereby;

said loops comprise an elongated core internally positioned within an elongated tubular outer jacket.

7. A skeleton ball in accordance with claim 1, whereby;

said loops comprise elongated tubular plastic elements, with interior spaces of said tubular elements containing granular material for purpose of increasing weight of said ball.

8. A skeleton ball in accordance with claim 1, whereby;

said loops comprise elongated tubular plastic elements, said joints are fluid-tight and interior spaces of said tubular elements contain fluid for purpose of increasing weight of said ball.

9. A skeleton ball in accordance with claim 1 whereby;

at least one of said loops differ from the remaining loops in terms of length.

10. A skeleton ball in accordance with claim 1, whereby;

at least one of said loops differ from the remaining loops in terms of elongated strand material selection.

11. A skeleton ball in accordance with claim 1 whereby;

a polyhedral geometry comprises a plurality of planar facets, each planar facet having a plurality of sides and a plurality of corners; said planar facets are arranged to form said polyhedral geometry such that three of said corners of three of said planar facets are coincident and form one vertex of said polyhedral geometry and two of said sides of two of said planar facets are coincident and form one edge of said polyhedral geometry;

said grid comprises a skeletal polyhedron having a plurality of loops and wherein a one-to-one correspondence exists between said loops of said skeletal polyhedron and said facets of said polyhedral geometry.

12. A skeleton ball in accordance with claim 1 whereby;

a polyhedral geometry comprises a plurality of hexagonal and pentagonal planar facets, each planar facet having a plurality of sides and a plurality of corners; said planar facets are arranged to form said polyhedral geometry such that three of said corners of three of said planar facets are coincident and form one vertex of said polyhedral geometry and two of said sides of two of said planar facets are coincident and form one edge of said polyhedral geometry;

said grid comprises a skeletal polyhedron having a plurality of loops and wherein a one-to-one correspondence exists between said loops of said skeletal polyhedron and said facets of said polyhedral geometry.

* * * * *